United States Patent [19]

Hoffmeister et al.

[11] 4,114,946

[45] Sep. 19, 1978

[54] MEDICAL TREATMENT CHAIR

[75] Inventors: Jurgen Hoffmeister, Biberach; Martin Saupe, Mittelbiberach, both of Germany

[73] Assignee: Kaltenbach & Voigt GmbH & Co., Biberach an der Riss, Germany

[21] Appl. No.: 799,692

[22] Filed: May 23, 1977

[30] Foreign Application Priority Data

May 28, 1976 [DE] Fed. Rep. of Germany ..... 7617191

[51] Int. Cl.[2] ..... A47C 7/62; A47C 1/02

[52] U.S. Cl. ..... 297/191; 297/330

[58] Field of Search ..... 297/330, 191, 188, 194; 312/320, 223; 200/157, 155 R, 6 A

[56] References Cited

U.S. PATENT DOCUMENTS

| | | | |
|---|---|---|---|
| 2,031,643 | 2/1936 | Granovsky | 297/217 X |
| 2,586,595 | 2/1952 | Ashby | 297/217 X |
| 3,019,050 | 1/1962 | Spielman | 297/191 X |
| 3,093,412 | 6/1963 | Gore et al. | 297/191 X |
| 3,198,574 | 8/1965 | Oto | 297/191 |
| 3,254,163 | 5/1966 | Wanless | 206/6 A |
| 3,341,268 | 9/1967 | Bickford | 312/223 X |
| 3,586,807 | 6/1971 | Guttinger | 200/6 A |
| 3,889,998 | 6/1975 | Weiland | 297/330 X |

FOREIGN PATENT DOCUMENTS

| | | | |
|---|---|---|---|
| 2,056,726 | 5/1972 | Fed. Rep. of Germany | 297/191 |

*Primary Examiner*—James T. McCall

*Attorney, Agent, or Firm*—Haseltine, Lake & Waters

[57] ABSTRACT

A medical treatment chair e.g. a dental chair, having switch housings releasably mounted on the back portion of the chair, and manually operated switches provided on the switch housings for electrically controlling the operation of parts of or associated with the chair e.g. movable parts of the chair or medical equipment to be used on a patient on the chair. A connecting cable is connected at one end to each switch housing and has a plug connector at its other end which engages a respective socket provided in the interior of the back portion. When the plug connector is in engagement with the socket, the cable prevents inadvertent removal of the switch housing from the back portion. To permit ready engagement and disengagement of each plug connector and socket, an access opening (normally closed) is provided in the back portion to enable manual manipulation of the plug connector and socket within the back portion.

10 Claims, 4 Drawing Figures

MEDICAL TREATMENT CHAIR

FIELD OF THE INVENTION

This invention relates to a medical treatment chair having a seat portion and a back portion and comprising switch housings releasably mounted on the back portion; manually operated switches provided on the switch housings for electrically controlling the operation of respective parts of or associated with the chair e.g. movable parts of the chair and medical equipment for use on a patient on the chair; and mounting locations provided on the back portion at predetermined positions for releasably mounting the switch housings.

Thus, the switch housings can be fitted to, and removed from various locations on the back portion depending on the wishes of the person treating the patient depending, for example, on whether treatment is to be carried out on the patient from one side, or from the other side, or from the rear.

DESCRIPTION OF PRIOR ART

A medical treatment chair of the above type is known from German Utility Model 71 22 985, in which the mounting locations for the switch housings comprise recesses which are formed in the upper portion of the chair. However, in this known arrangement, it is possible for the switch housings to be removed by mistake and laid aside to become lost. It is also possible for the switch housings to become loose in the recesses so that switching operations cannot be carried out.

It is an object of the invention to provide a medical treatment chair in which inadvertent removal of the switch housings can be prevented, while at the same time switching operations can be carried out even if the switch housings become loose in the mounting locations.

SUMMARY OF THE INVENTION

According to the invention there is provided a medical treatment chair having a seat portion and a back portion and comprising:

- switch housings releasably mounted on said back portion;
- manually operated switches provided on said housings for electrically controlling the operation of respective parts of or associated with the chair;
- mounting locations provided on said back portion and releasably mounting said switch housings;
- a respective connecting cable connected at one end to each of said housings;
- a respective plug connector connected to an end of each cable remote from said one end;
- a respective socket provided within the back portion for engagement by each of said plug connectors;
- and an access opening provided in the back portion to permit manual manipulation of said plug connectors and said sockets within said back portion.

If desired, the back portion may include an integral or fitted-on headrest, and some or all of the switch housings, mounting locations, sockets and the access opening may be provided on or in the headrest.

If a switch housing is mistakenly removed from the respective mounting location in which it is accommodated, it cannot be mislaid or lost since it is always connected to the upper portion of the chair by means of the connecting cable. If a switch housing is to be intentionally removed, all that is required for the purpose is to reach through the access opening and to separate the appropriate plug connector from its socket, after which the switch housing, separated from the mounting location in which it is accommodated, can be removed. The fitting of a switch housing in the upper portion of the chair takes place in the reverse order. If a switch housing becomes loose in its mounting location, switching operations can still be carried out since the connection between the plug connector on the connecting cable of the switch housing and the socket continues to be maintained.

Expediently, each socket consists of a socket strip having contact holes for receiving contact pins of the plug connectors. The mounting locations for accommodating the switch housings may each consist of a socket bush for receiving a plug extension of the switch housing, and to ensure ease of release and at the same time an adequate holding action, the plug extension and/or the socket bush is or are made of resilient material or incorporate cooperating resilient parts.

Openings for admitting the connecting cables are preferably formed in the bases of the socket bushes, the opening to the bushes being preferably flush with the surface of the upper portion of the chair. The mounting locations for accommodating the switch housings are each preferably formed in the lateral edge and/or the upper edge of the upper portion of the chair.

A particularly simple arrangement whereby the plug connection can be easily reached consists in forming the upper portion of the chair as an open box, the open side of which forms the access opening through which the socket elements can be reached and which can be closed by a removable, e.g. a hinged or liftout, cushioned covering. Also, the open box can be removable rather than the cushioned covering.

In a further preferred arrangement, one end of a movable supporting member is mounted, preferably releasably, on the upper portion of the chair, a mounting location for accommodating a switch housing being arranged at the free end of this supporting member.

Thus, to suit particular cases and depending upon the wishes and needs of the doctor or an assistant, the switch housing can be moved to a still larger number of locations in the end or upper zone of the chair. Expediently, the movable supporting member consists of a pivotable lever which is mounted on a pivot pin which extends substantially at right-angles to the central support surface for the patient, which surface is formed by the upper portion of the chair, the opening for admitting the connecting cable consisting of a slot which is formed in the upper portion of the chair and is disposed within the plane in which the lever pivots and limits the movement of the lever.

DESCRIPTION OF THE PREFERRED EMBODIMENTS

In the embodiments of medical treatment chair according to the invention, the chair has a seat portion, a back portion, and manually operable switches provided on the back portion for electrically controlling the operation of parts of or associated with the chair.

The "back portion" of the chair may comprise a backrest only, or may comprise a backrest and an integral or fitted-on headrest as shown in the accompanying drawings.

Figure 1:
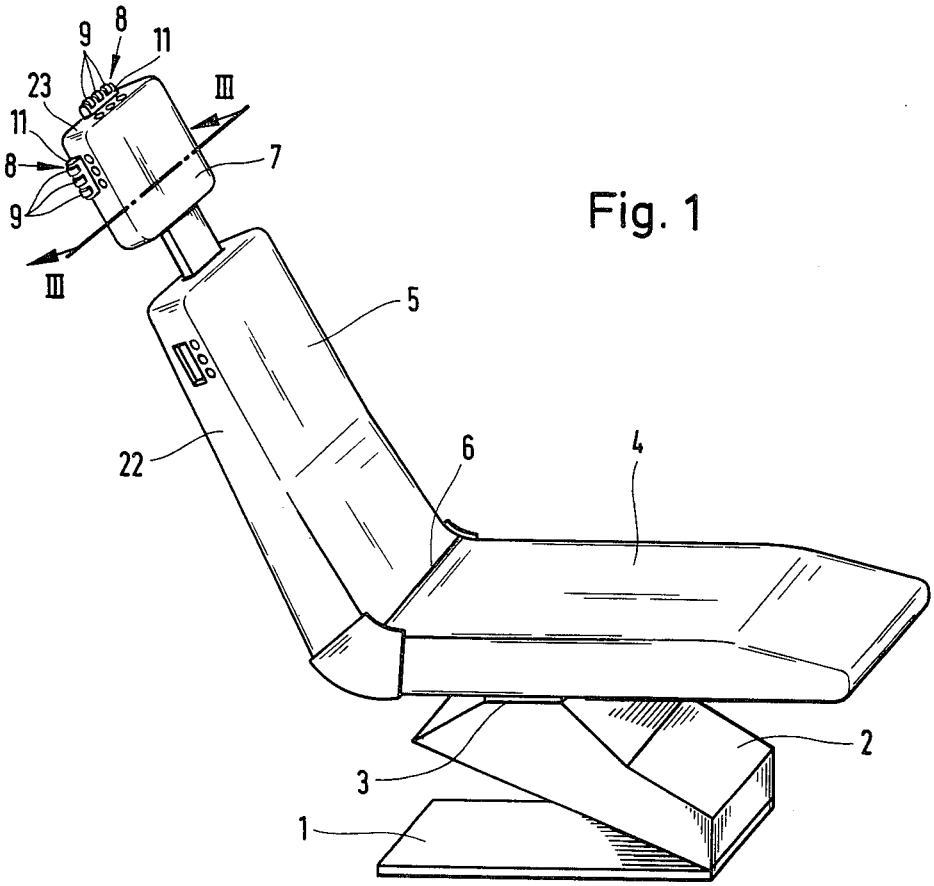
FIG. 1 is a perspective view of a medical treatment chair, e.g. a dental chair, in accordance with the invention.

Referring to FIG. 1, the patient's chair has a pedestal 1, to which is secured a support arm 2 which carries, by way of a support 3, the seat 4 with the back-rest 5. The seat 4 together with the backrest 5 can be vertically displaced and can be variously inclined about the horizontal axis 6, for example with the aid of an electromotive, pneumatic or hydraulic drive, not illustrated. The inclination of the backrest 5 relative to the seat 4 can likewise be adjusted about the axis 6.

In the upper zone of the backrest 5 or on a head support 7, are detachably fitted manually-operated switches of a switch unit, designated generally by the reference numeral 8 and consisting of three individual switches, for controlling medical appliances, e.g. the above-mentioned adjustable chair parts 4 and 5, or for moving a dental hand-drill to the right or the left. The backrest 5 and the head support 7 form the upper portion of the chair.

Figure 2:
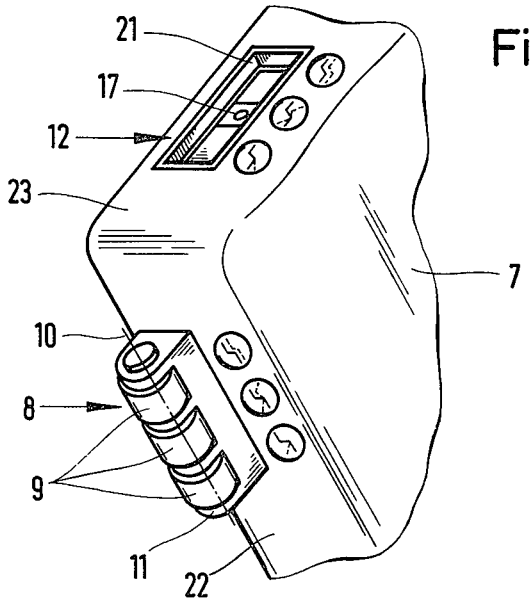
FIG. 2 shows, on a larger scale, a modified form of the upper end of the head-support of the chair shown in FIG. 1.

Each of the individual switches of the unit 8 has an actuating element 9 which, for example, can be moved from a central neutral position into either of two opposite end positions about a pivot pin 10 (FIG. 2). The individual switches with their actuating elements 9 are arranged in groups in a switch housing 11, each group consisting of three switches in the illustrated example.

Figure 4:
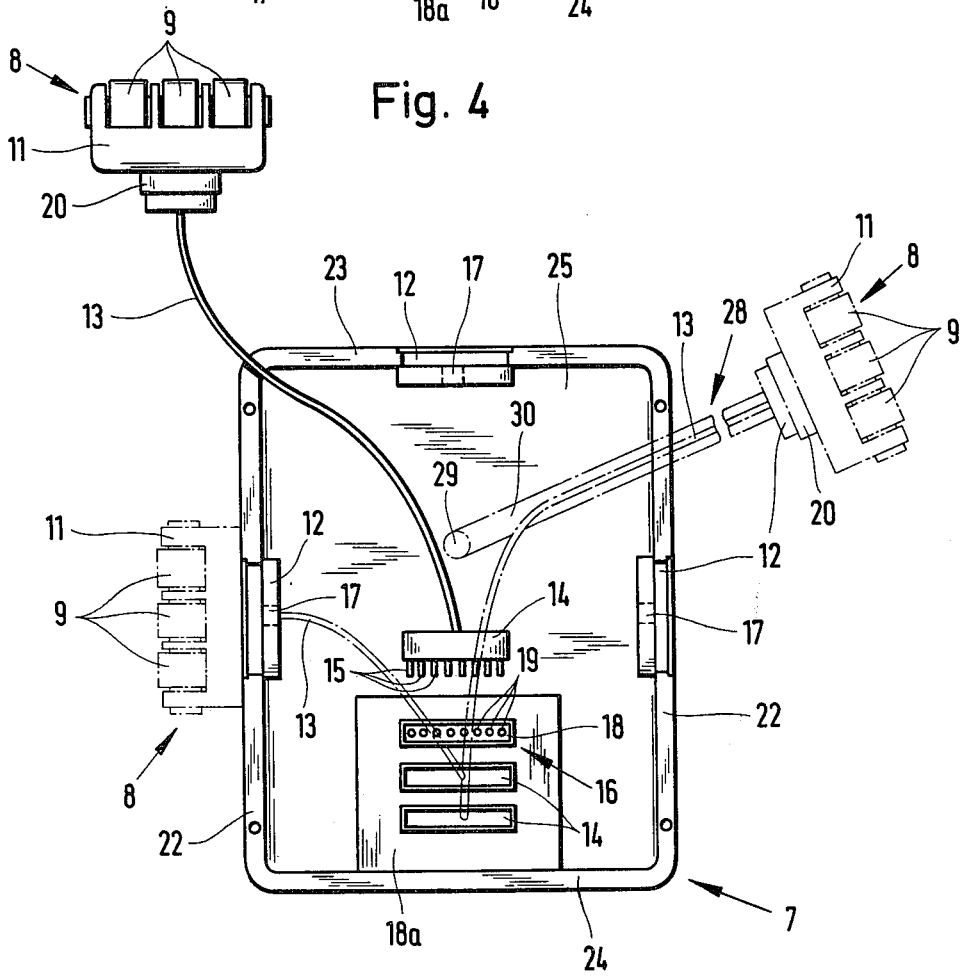
FIG. 4 illustrates a slightly modified form of the FIG. 3 head-support seen in the direction of the arrow IV in FIG. 3, the cushioned covering being removed.

Provided at the end or upper zone of the upper portion 5 or 7 of the chair are elements 12 for accommodating the switch housings. Referring to FIG. 4, each of the switch housings 11 is provided with a connecting cable 13, at the free end of which is fitted a plug 14 with contact pins 15. A socket element 16 is provided for each plug 14 in the interior of the upper part 5 or 7 of the chair. Formed in the surface of the upper part 5 or 7 of the chair is an opening 17 (FIG. 2) for admitting each of the connecting cables 13. Each opening 17 may be constructed large enough to enable the plug 14 to pass through it. Alternatively, the cables 13 may be taken through openings 17 as shown in FIG. 2, in which case connections will be made between the cables 13 and the plugs 14, or the housings 11, only after the cables 13 have been taken through the openings 17.

Each socket element 16 consists of a strip 18 having contact holes 19 for receiving the contact pins 15 of a plug 14. The socket strips 18 are arranged on a baseplate 18*a* in the interior of the upper part 5 or 7 of the chair. As shown in FIG. 2, each of the elements 12 for accommodating the switch housings is formed by a socket bush 21 of rectangular cross-section matching that of a plug extension 20 of the switch housing 11 so that the extension can be fitted into it, the opening of the socket bush 21 lying flush with the surface of the upper part 5 or 7 of the chair. The opening 17 is formed in the base of the socket bush 21.

Each of the elements 12 for accommodating a switch housing 11 is disposed in the side 22 and/or at the upper side 23 of the upper portion 5 or 7 of the chair.

Figure 3:
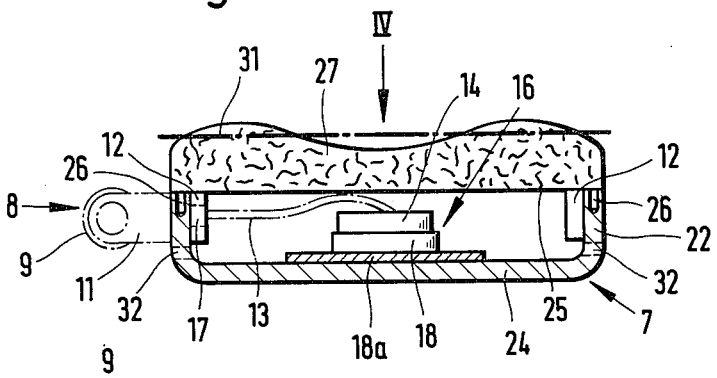
FIG. 3 is a sectional view taken along line III—III of FIG. 1, through the head-support of the chair.

As shown in FIGS. 3 and 4, the upper portion 5 or 7 of the chair is formed by an opening box 24, the open side of which forms an opening 25 through which the socket strips 18 can be reached and the plugs 14 inserted and removed. The opening 25 can be closed by a removable cushioned covering 27 which can be secured by, for example, screws 26.

In the arrangement shown in FIG. 4, one end of a movable support member 28 is mounted, preferably detachably, on the upper portion 5 or 7 of the chair, and an element 12 for accommodating the extension 20 of a switch housing 11 is arranged at the free end of this support member. The support member 28 may consist, for example, of a flexible arm which dwells in each of the positions into which it is brought. In the arrangement illustrated in FIG. 4, the support member 28 consists of a rocking lever 30, which is mounted on the upper portion 5 or 7 of the chair by means of a pivot pin 29, which extends substantially at right-angles to the central patient supporting surface 31 (FIG. 3), which surface is formed by the upper portion 5 or 7 of the chair. The opening (equivalent to the previously described openings 17) for admitting the connecting cable 13 consists of a slot 32, indicated in FIG. 3, disposed substantially in the plane in which the lever 30 (FIG. 4) rocks. The length of the slot 32 corresponds to the required range of movement of the rocking lever 30.

In the FIG. 4 illustration, the cushioned covering 27, shown in FIG. 3, has been removed. The switch housing seen at the left at the top of FIG. 4 is in the position it occupies just before its plug extension 20 is inserted in the housing-accommodating element 12 disposed in the upper edge 23 of the upper part 5 or 7 of the chair, and the plug 14 is seen in the position that it occupies just before being inserted into the upper socket element 18 shown in FIG. 4.

We claim:

1. A medical treatment chair having a seat portion and a back portion and comprising:

switch housings releasably mounted on said back portion;

manually operated switches provided on said housings for electrically controlling the operation of respective parts of or associated with the chair;

mounting locations provided on said back portion and releasably mounting said switch housings;

a respective connecting cable connected at one end to each of said housings;

a respective plug connector connected to an end of each cable remote from said one end;

a respective socket provided within the back portion for engagement by each of said plug connectors;

an access opening in the back portion to permit manual manipulation of said plug connectors and said sockets within said back portion; and removable closure means mounted on said back portion for closing said access opening.

2. A medical treatment chair as defined in claim 1 including: plug-in bushings for a plug extension of said switch housings, said bushings being placed at said mounting locations for said switch housing and having a bottom, said bushings having an opening flush with the surface of the back portion of the chair (5 or 7), said bottom of said plug-in bushings having a breakout (17) for a connecting cable (13), said plug-in bushings (21) and said plug extension (20) being of resilient material.

3. A medical treatment chair as defined in claim 1, including contact pins on each of said plug connectors, and socket strips in each of said sockets and having contact holes for receiving said contact pins.

4. A medical treatment chair according to claim 1, wherein the mounting locations are in at least one of the sides and the top of said back portion.

5. A medical treatment chair according to claim 1, wherein said back portion includes a headrest, and at least some of said switch housings, said mounting locations, said sockets and said access opening are on said headrest.

6. A medical treatment chair according to claim 1, including an open box forming an upper end of said back portion and defining said access opening, and a removable cushioned covering closing said opening.

7. A medical treatment chair according to claim 1, including a support member movably mounted at one end on said back portion, and a mounting location at an opposite end of said support member for mounting a switch housing.

8. A medical treatment chair according to claim 7, wherein said support member comprises a lever mounted on said back portion for pivotal movement about an axis extending substantially perpendicular to a central patient-support surface of said back portion.

9. A medical treatment chair according to claim 8, including a slot provided in said back portion through which said lever extends, said slot extending in the plane of movement of said lever and limiting the pivotal movement thereof, and said slot also permitting one of said cables to be taken therethrough to connect a switch housing at one end of said lever to a respective one of said sockets.

10. A medical treatment chair according to claim 7, wherein said support member is releasably mounted on said back portion.

* * * * *